US010247121B2

(12) United States Patent
Shost et al.

(10) Patent No.: US 10,247,121 B2
(45) Date of Patent: Apr. 2, 2019

(54) METHOD AND APPARATUS FOR DETERMINING OPTIMUM SKIP FIRE FIRING PROFILE

(71) Applicants: Tula Technology Inc., San Jose, CA (US); GM Global Technology Operations LLC, Detroit, MI (US)

(72) Inventors: Mark A. Shost, Northville, MI (US); Louis J. Serrano, Los Gatos, CA (US); Steven E. Carlson, Oakland, CA (US); Vijay Srinivasan, Farmington Hills, MI (US); Eric J. Defenderfer, Brighton, MI (US); Nitish J. Wagh, Northville, MI (US); Randall S. Beikmann, Brighton, MI (US); Jinbiao Li, Rochester Hills, MI (US); Xin Yuan, Palo Alto, CA (US); Li-Chun Chien, Milpitas, CA (US)

(73) Assignees: Tula Technology, Inc., San Jose, CA (US); GM Global Technology Operations LLC, Detroit, MI (US)

( * ) Notice: Subject to any disclaimer, the term of this patent is extended or adjusted under 35 U.S.C. 154(b) by 562 days.

(21) Appl. No.: 14/638,908

(22) Filed: Mar. 4, 2015

(65) Prior Publication Data

US 2015/0260117 A1 Sep. 17, 2015

Related U.S. Application Data

(60) Provisional application No. 61/952,737, filed on Mar. 13, 2014.

(51) Int. Cl.
*F02D 17/02* (2006.01)
*F02D 41/00* (2006.01)
(Continued)

(52) U.S. Cl.
CPC ..... *F02D 41/0087* (2013.01); *F02D 17/02* (2013.01); *F02D 41/2422* (2013.01);
(Continued)

(58) Field of Classification Search
CPC ..... F02D 11/105; F02D 13/06; F02D 17/02; F02D 2041/0012; F02D 41/0087; F02D 41/0225; F02D 41/1406; F02D 41/2422
(Continued)

(56) References Cited

U.S. PATENT DOCUMENTS 4,172,434 A * 10/1979 Coles ..... F02D 41/0087 123/198 F
4,434,767 A * 3/1984 Kohama ..... F02D 41/0087 123/198 F
(Continued)

FOREIGN PATENT DOCUMENTS

JP 06159110 A * 6/1994

OTHER PUBLICATIONS

Shost et al., U.S. Appl. No. 15/171,931, filed Jun. 2, 2016.
(Continued)

*Primary Examiner* — John M Zaleskas
(74) *Attorney, Agent, or Firm* — Beyer Law Group LLP

(57) ABSTRACT

In one aspect, a skip fire engine controller is described. The skip fire engine controller includes a skip fire module arranged to determine an operational firing fraction and associated cylinder load for delivering a desired engine output. The skip fire engine controller also includes a firing controller arranged to direct firings in a skip fire manner that delivers the selected operational firing fraction. Various methods, modules, lookup tables and arrangements related to the selection of a suitable operational firing fraction are also described.

25 Claims, 9 Drawing Sheets

(51) Int. Cl.
*F02D 41/24* (2006.01)
*F02D 41/02* (2006.01)
*F02D 41/14* (2006.01)

(52) U.S. Cl.
CPC ..... *F02D 41/0225* (2013.01); *F02D 41/1406* (2013.01); *F02D 2200/101* (2013.01)

(58) Field of Classification Search
USPC ..... 123/198 F, 481
See application file for complete search history.

(56) References Cited

U.S. PATENT DOCUMENTS 4,489,695 A * 12/1984 Kohama ..... F02D 17/02 123/198 F
4,509,488 A * 4/1985 Forster ..... F02D 41/0087 123/198 F
4,541,387 A 9/1985 Morikawa
5,154,151 A * 10/1992 Bradshaw ..... B60K 28/16 123/198 F
5,368,000 A * 11/1994 Koziara ..... F02B 75/06 123/192.2
5,377,631 A * 1/1995 Schechter ..... F01L 9/02 123/198 F
5,408,966 A 4/1995 Lipinski et al.
5,408,974 A * 4/1995 Lipinski ..... F02D 17/02 123/198 F
5,553,575 A 9/1996 Beck et al.
5,584,266 A 12/1996 Motose et al.
5,692,471 A 12/1997 Zhang
5,720,257 A 2/1998 Motose et al.
5,778,858 A * 7/1998 Garabedian ..... F02D 41/1443 123/481
5,884,603 A * 3/1999 Matsuki ..... B60K 28/16 123/198 F
5,975,052 A 11/1999 Moyer
6,158,411 A * 12/2000 Morikawa ..... F02D 37/02 123/304
6,244,242 B1 * 6/2001 Grizzle ..... F02D 17/02 123/295
6,247,449 B1 6/2001 Persson
6,360,724 B1 * 3/2002 Suhre ..... F02D 17/02 123/198 F
6,408,625 B1 6/2002 Woon et al.
6,619,258 B2 9/2003 McKay et al.
6,687,602 B2 * 2/2004 Ament ..... F02D 11/105 123/198 F
6,978,204 B2 12/2005 Surnilla et al.
7,032,545 B2 4/2006 Lewis et al.
7,032,581 B2 4/2006 Gibson et al.
7,044,101 B1 * 5/2006 Duty ..... F02D 17/02 123/198 F
7,063,062 B2 6/2006 Lewis et al.
7,066,136 B2 6/2006 Ogiso
7,086,386 B2 8/2006 Doering et al.
7,111,612 B2 9/2006 Michellini et al.
7,278,391 B1 10/2007 Wong et al.
7,503,312 B2 3/2009 Surnilla et al.
7,509,201 B2 3/2009 Bolander et al.
7,577,511 B1 * 8/2009 Tripathi ..... F02D 41/0087 701/103
7,651,441 B2 1/2010 Maguire et al.
7,785,230 B2 * 8/2010 Gibson ..... B60W 30/20 477/101
7,836,866 B2 * 11/2010 Luken ..... F02D 17/02 123/481
7,930,087 B2 4/2011 Gibson et al.
8,099,224 B2 1/2012 Tripathi et al.
8,108,132 B2 1/2012 Reinke
8,135,410 B2 3/2012 Berger et al.
8,145,410 B2 * 3/2012 Berger ..... B60K 6/365 701/111
8,146,565 B2 4/2012 Leone et al.
8,473,179 B2 6/2013 Whitney et al.
8,606,483 B2 12/2013 Krupadanam et al.
8,869,773 B2 10/2014 Tripathi et al.
9,020,735 B2 4/2015 Tripathi et al.
9,399,964 B2 7/2016 Younkins et al.
9,482,202 B2 11/2016 Carlson et al.
9,528,446 B2 12/2016 Pirjaberi et al.
2003/0116130 A1 6/2003 Kisaka et al.
2003/0131820 A1 * 7/2003 Mckay ..... F01L 13/0005 123/198 F
2003/0123467 A1 11/2003 Rayl et al.
2005/0199220 A1 * 9/2005 Ogiso ..... F02D 13/06 123/481
2006/0130814 A1 * 6/2006 Bolander ..... F02D 13/06 123/481
2007/0029712 A1 2/2007 Nemoto
2008/0154468 A1 6/2008 Berger et al.
2009/0007877 A1 1/2009 Raiford
2009/0177371 A1 * 7/2009 Reinke ..... F02D 17/04 701/111
2010/0006065 A1 * 1/2010 Tripathi ..... F02D 41/0087 123/350
2010/0010724 A1 * 1/2010 Tripathi ..... F02D 41/0087 701/103
2010/0012072 A1 * 1/2010 Leone ..... F02D 41/0087 123/192.1
2010/0043744 A1 2/2010 Suzuki et al.
2010/0050993 A1 * 3/2010 Zhao ..... F02D 17/02 123/481
2010/0059004 A1 * 3/2010 Gill ..... F02B 29/083 123/90.11
2010/0100299 A1 * 4/2010 Tripathi ..... F02D 41/0087 701/102
2011/0030657 A1 * 2/2011 Tripathi ..... F02D 17/02 123/481
2011/0048372 A1 * 3/2011 Dibble ..... F02D 41/0087 123/350
2011/0208405 A1 * 8/2011 Tripathi ..... F02D 17/02 701/102
2011/0213540 A1 * 9/2011 Tripathi ..... F02D 37/02 701/102
2012/0221217 A1 * 8/2012 Sujan ..... B60W 10/06 701/54
2012/0285161 A1 11/2012 Kerns et al.
2013/0092127 A1 * 4/2013 Pirjaberi ..... F02D 41/0087 123/406.23
2013/0289853 A1 * 10/2013 Serrano ..... F02D 45/00 701/110
2014/0041625 A1 * 2/2014 Pirjaberi ..... F02D 41/00 123/349
2014/0045652 A1 * 2/2014 Carlson ..... B60W 10/06 477/109
2014/0046558 A1 2/2014 Kim
2014/0053802 A1 2/2014 Rayl
2014/0053804 A1 2/2014 Rayl et al.
2014/0053805 A1 2/2014 Brennan et al.
2014/0069178 A1 3/2014 Beikmann
2014/0069378 A1 3/2014 Burleigh et al.
2014/0069379 A1 3/2014 Beikmann
2014/0069381 A1 3/2014 Beikmann
2014/0090623 A1 4/2014 Beikmann
2014/0090624 A1 4/2014 Verner
2014/0102411 A1 4/2014 Brennan
2015/0100221 A1 4/2015 Routledge et al.
2015/0354470 A1 12/2015 Li et al.
2016/0252023 A1 9/2016 Srinivasan et al.
2017/0370301 A1 12/2017 Srinivasan
2017/0370342 A1 12/2017 Nagashima et al.

OTHER PUBLICATIONS

Nagashima et al, U.S. Appl. No. 15/147,690, filed May 5, 2016.
Srinivasan et al., U.S. Appl. No. 15/148,826, filed May 6, 2016.
Srinivasan et al., U.S. Appl. No. 15/148,843, filed May 6, 2016.
International Search Report dated Jun. 17, 2015 from International Application No. PCT/US2015/019496.

(56) References Cited

OTHER PUBLICATIONS

Written Opinion dated Jun. 17, 2015 from International Application No. PCT/US2015/019496.
Chinese Office Action dated Nov. 28, 2018 from Chinese Application No. 201580012383.7.

* cited by examiner

340

350

370

360

| | Engine speed (rpm) | | | | | | | | | | | |
|---|---|---|---|---|---|---|---|---|---|---|---|---|
| ETF | 825 | 1000 | 1250 | 1500 | 1750 | 2000 | 2250 | 2500 | 2750 | 3000 | 3250 | 3350 |
| 0 | 0 | 0 | 0 | 0 | 0 | 0 | 0 | 0 | 0 | 0 | 0 | 0 |
| 0.05 | 0.140 | 0.105 | 0.091 | 0.086 | 0.084 | 0.082 | 0.079 | 0.077 | 0.076 | 0.073 | 0.071 | 0.070 |
| 0.1 | 0.280 | 0.211 | 0.181 | 0.172 | 0.168 | 0.164 | 0.159 | 0.155 | 0.152 | 0.146 | 0.143 | 0.140 |
| 0.15 | 0.420 | 0.316 | 0.272 | 0.258 | 0.251 | 0.246 | 0.238 | 0.232 | 0.227 | 0.220 | 0.214 | 0.211 |
| 0.2 | 0.560 | 0.421 | 0.362 | 0.344 | 0.335 | 0.328 | 0.318 | 0.310 | 0.303 | 0.293 | 0.286 | 0.281 |
| 0.25 | 0.700 | 0.526 | 0.453 | 0.430 | 0.419 | 0.410 | 0.397 | 0.387 | 0.379 | 0.366 | 0.357 | 0.351 |
| 0.3 | 0.840 | 0.632 | 0.543 | 0.516 | 0.503 | 0.492 | 0.477 | 0.464 | 0.455 | 0.439 | 0.429 | 0.421 |
| 0.35 | 0.980 | 0.737 | 0.634 | 0.602 | 0.586 | 0.574 | 0.556 | 0.542 | 0.530 | 0.512 | 0.500 | 0.492 |
| 0.4 | - | 0.842 | 0.725 | 0.688 | 0.670 | 0.656 | 0.636 | 0.619 | 0.606 | 0.586 | 0.571 | 0.562 |
| 0.45 | - | 0.947 | 0.815 | 0.775 | 0.754 | 0.738 | 0.715 | 0.697 | 0.682 | 0.659 | 0.643 | 0.632 |
| 0.5 | - | - | 0.906 | 0.861 | 0.838 | 0.820 | 0.795 | 0.774 | 0.758 | 0.732 | 0.714 | 0.702 |
| 0.55 | - | - | 0.996 | 0.947 | 0.921 | 0.902 | 0.874 | 0.851 | 0.833 | 0.805 | 0.786 | 0.772 |
| 0.6 | - | - | - | - | - | 0.984 | 0.954 | 0.929 | 0.909 | 0.878 | 0.857 | 0.843 |
| 0.65 | - | - | - | - | - | - | - | - | 0.985 | 0.952 | 0.929 | 0.913 |
| 0.7 | - | - | - | - | - | - | - | - | - | - | 1.000 | 0.983 |
| 0.75 | - | - | - | - | - | - | - | - | - | - | - | - |
| 0.8 | - | - | - | - | - | - | - | - | - | - | - | - |
| 0.85 | - | - | - | - | - | - | - | - | - | - | - | - |
| 0.9 | - | - | - | - | - | - | - | - | - | - | - | - |
| 0.95 | - | - | - | - | - | - | - | - | - | - | - | - |
| 1 | - | - | - | - | - | - | - | - | - | - | - | - |

*FIG. 3*

300

370 374 372 373

| | | Engine speed (rpm) | | | | | | | | | | | |
|---|---|---|---|---|---|---|---|---|---|---|---|---|---|
| Firing fraction | Firing frequency | 825 | 850 | 875 | 900 | 925 | 950 | 975 | 1000 | 1025 | ... | 3475 | 3500 |
| 1/9 | 0.111 | 0 | 0 | 0 | 0 | 0 | 0 | 0 | 0 | 0.03 | .... | 0.24 | 0.25 |
| 1/8 | 0.125 | 0 | 0 | 0 | 0 | 0 | 0 | 0 | 0.07 | 0.15 | .... | 0.32 | 0.32 |
| 1/7 | 0.143 | 0 | 0 | 0 | 0.31 | 0.29 | 0.27 | 0.26 | 0.25 | 0.33 | .... | 0.17 | 0.17 |
| 1/6 | 0.167 | 0.25 | 0.26 | 0.27 | 0.28 | 0.29 | 0.3 | 0.305 | 0.31 | 0.315 | .... | 0.43 | 0.44 |
| 1/5 | 0.200 | 0.14 | 0.16 | 0.17 | 0.16 | 0.14 | 0.12 | 0.08 | 0.06 | 0.04 | .... | 0.29 | 0.29 |
| 2/9 | 0.222 | 0 | 0 | 0 | 0 | 0 | 0 | 0 | 0.03 | 0.07 | .... | 0.26 | 0.27 |
| 1/4 | 0.250 | 0.25 | 0.26 | 0.28 | 0.32 | 0.37 | 0.42 | 0.47 | 0.51 | 0.55 | .... | 0.79 | 0.8 |
| 2/7 | 0.286 | 0.23 | 0.26 | 0.28 | 0.31 | 0.29 | 0.27 | 0.26 | 0.25 | 0.23 | .... | 0.18 | 0.18 |
| 1/3 | 0.333 | 0.48 | 0.5 | 0.52 | 0.54 | 0.56 | 0.58 | 0.59 | 0.6 | 0.61 | .... | 0.6 | 0.71 |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| 2/3 | 0.667 | 0.64 | 0.67 | 0.69 | 0.72 | 0.75 | 0.77 | 0.79 | 0.80 | 0.81 | .... | 0.32 | 0.33 |
| 5/7 | 0.714 | 0.31 | 0.35 | 0.37 | 0.41 | 0.39 | 0.36 | 0.35 | 0.33 | 0.31 | .... | 0.43 | 0.43 |
| 3/4 | 0.750 | 0.33 | 0.35 | 0.37 | 0.43 | 0.49 | 0.56 | 0.63 | 0.68 | 0.73 | .... | 0.23 | 0.23 |
| 7/9 | 0.778 | 0 | 0 | 0 | 0 | 0 | 0 | 0 | 0.04 | 0.09 | .... | 0.57 | 0.59 |
| 4/5 | 0.800 | 0.19 | 0.21 | 0.23 | 0.21 | 0.19 | 0.16 | 0.11 | 0.08 | 0.05 | .... | 0.39 | 0.39 |
| 5/6 | 0.833 | 0.33 | 0.35 | 0.36 | 0.37 | 0.39 | 0.40 | 0.41 | 0.41 | 0.42 | .... | 0.35 | 0.36 |
| 6/7 | 0.857 | 0 | 0 | 0 | 0.41 | 0.39 | 0.36 | 0.35 | 0.33 | 0.44 | .... | 1.00 | 1.00 |
| 7/8 | 0.875 | 0 | 0 | 0 | 0 | 0 | 0 | 0 | 0.09 | 0.20 | .... | 0.24 | 0.24 |
| 8/9 | 0.889 | 0 | 0 | 0 | 0 | 0 | 0 | 0 | 0 | 0.04 | .... | 0.80 | 0.95 |
| 1 | 1 | 1 | 1 | 1 | 1 | 1 | 1 | 1 | 1 | 1 | .... | 1.00 | 1.00 |

*FIG. 6*

700

740

| Firing fraction | Firing frequency | Maximum allowed CTF | Range 1 | | Range 2 | | Range 3 | |
|---|---|---|---|---|---|---|---|---|
| | | | Min. rpm | Max. rpm | Min. rpm | Max. rpm | Min. rpm | Max. rpm |
| 1/4 | 0.250 | 0.10 | 600 | 3500 | | | | |
| 1/4 | 0.250 | 0.20 | 625 | 850 | 900 | 2100 | 2200 | 3500 |
| 1/4 | 0.250 | 0.40 | 650 | 750 | 1050 | 1800 | 2300 | 3500 |
| 1/4 | 0.250 | 0.60 | 1100 | 1700 | 2300 | 3500 | | |
| 1/4 | 0.250 | 0.80 | 1200 | 1250 | 1300 | 1600 | 2400 | 3500 |
| 1/4 | 0.250 | 1.00 | 1325 | 1550 | 2450 | 3500 | | |
| 2/7 | 0.286 | 0.10 | 700 | 1100 | 1200 | 2700 | | |
| 2/7 | 0.286 | 0.20 | 750 | 1000 | 1300 | 2600 | | |
| 2/7 | 0.286 | 0.40 | 1400 | 2500 | | | | |
| 2/7 | 0.286 | 0.60 | 1500 | 1600 | 1800 | 2500 | | |
| 2/7 | 0.286 | 0.80 | 1900 | 2400 | | | | |
| 2/7 | 0.286 | 1.00 | 2000 | 2300 | | | | |
| 1/3 | 0.333 | 0.10 | 600 | 3500 | | | | |
| 1/3 | 0.333 | 0.20 | 625 | 1400 | 1600 | 2200 | 2300 | 3500 |
| 1/3 | 0.333 | 0.40 | 700 | 1300 | 1650 | 2150 | 2350 | 3500 |
| 1/3 | 0.333 | 0.60 | 1000 | 1100 | 1750 | 2050 | 2500 | 3500 |
| 1/3 | 0.333 | 0.80 | 1775 | 2025 | | | | |
| 1/3 | 0.333 | 1.00 | 1800 | 2000 | | | | |

*FIG. 7*

METHOD AND APPARATUS FOR DETERMINING OPTIMUM SKIP FIRE FIRING PROFILE

CROSS-REFERENCE TO RELATED APPLICATIONS

This application claims priority to U.S. Provisional Patent Application No. 61/952,737, entitled "Method and Apparatus for Determining Optimum Skip Fire Firing Profile," filed Mar. 13, 2014, which is incorporated herein in its entirety for all purposes.

FIELD OF THE INVENTION

The present invention relates to methods and systems for operating an engine in a skip fire manner. More specifically, different possible working chamber output levels are taken into account to help determine an optimal skip fire firing profile.

BACKGROUND

Most vehicles in operation today (and many other devices) are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver. Over the years, a number of methods of controlling internal combustion engine torque have been proposed and utilized. Some such approaches contemplate varying the effective displacement of the engine. Engine control approaches that vary the effective displacement of an engine can be classified into two types of control, multiple fixed displacements and skip fire. In fixed multiple displacement control some fixed set of cylinders is deactivated under low load conditions; for example, an 8 cylinder engine that can operate on the same 4 cylinders under certain conditions. In contrast, skip fire control operates by sometimes skipping and sometimes firing any given cylinder. In general, skip fire engine control is understood to offer a number of potential advantages, including the potential of significantly improved fuel economy in many applications. Although the concept of skip fire engine control has been around for many years, and its benefits are understood, skip fire engine control has not yet achieved significant commercial success.

It is well understood that operating engines tend to be the source of significant noise and vibrations, which are often collectively referred to in the field as NVH (noise, vibration and harshness). In general, a stereotype associated with skip fire engine control is that skip fire operation of an engine will make the engine run significantly rougher, that is with increased NVH, relative to a conventionally operated engine. In many applications such as automotive applications, one of the most significant challenges presented by skip fire engine control is vibration control. Indeed, the inability to satisfactorily address NVH concerns is believed to be one of the primary obstacles that has prevented widespread adoption of skip fire types of engine control.

U.S. Pat. Nos. 7,954,474; 7,886,715; 7,849,835; 7,577,511; 8,099,224; 8,131,445 and 8,131,447 and U.S. patent application Ser. Nos. 13/004,839; 13/004,844; and others, describe a variety of engine controllers that make it practical to operate a wide variety of internal combustion engines in a skip fire operational mode. Each of these patents and patent applications is incorporated herein by reference. Although the described controllers work well, there are continuing efforts to further improve the performance of these and other skip fire engine controllers to further mitigate NVH issues in engines operating under skip fire control. The present application describes additional skip fire control features and enhancements that can improve engine performance in a variety of applications.

SUMMARY

The present invention relates to methods and arrangements for operating an engine in a skip fire manner. In one aspect, a skip fire engine controller is described. The skip fire engine controller includes a skip fire profile module and a firing controller. The skip fire profile module is arranged to determine an operational firing fraction and associated cylinder load for delivering a desired engine output. The skip fire profile module is arranged to select the operational firing fraction from a set of available firing fractions. The set of available firing fractions varies as a function of cylinder load such that more firing fractions are available at lower cylinder loads than at higher cylinder loads. The firing controller is arranged to direct firings in a skip fire manner that delivers the selected operational firing fraction.

In another aspect, a skip fire engine controller is described. The skip fire engine controller includes a lookup table, a skip fire profile module and a firing controller. The lookup table is embodied in a computer readable media and includes table entries that indicate different maximum allowable cylinder loads at different engine speeds, transmission gears, and firing fractions. The skip fire profile module is arranged to determine an operational firing fraction suitable for delivering a requested engine output. The skip fire profile module utilizes the lookup table to determine the operational firing fraction. The firing controller is arranged to direct firings in a skip fire manner that delivers the operational firing fraction.

In still another aspect, a method for selecting an operational skip fire firing profile will be described. A desired engine output is determined. Multiple candidate firing fractions are selected from an allowed list of firing fractions. The candidate cylinder load for each of the candidate firing fractions is calculated such that the combination of the candidate cylinder load and each associated candidate firing fraction substantially yields the desired engine output. Each such combination is referred to as a candidate skip fire firing profile. One of the candidate skip fire firing profiles is selected as the operational skip fire firing profile. The internal combustion engine is operated based at least in part on the selected operational skip fire firing profile.

BRIEF DESCRIPTION OF THE DRAWINGS

The invention and the advantages thereof, may best be understood by reference to the following description taken in conjunction with the accompanying drawings in which:

FIG. 3 is an exemplary look up table compiling the base firing frequency for a range of engine torque fractions and engine speeds.

FIG. 6 is an exemplary two-dimensional look up table compiling the maximum acceptable cylinder load as a function of firing fraction and engine speed.

FIG. 7 is an exemplary one-dimensional look up table compiling acceptable engine speeds as a function of skip fire firing profiles.

In the drawings, like reference numerals are sometimes used to designate like structural elements. It should also be appreciated that the depictions in the figures are diagrammatic and not to scale.

DETAILED DESCRIPTION

Figure 1:
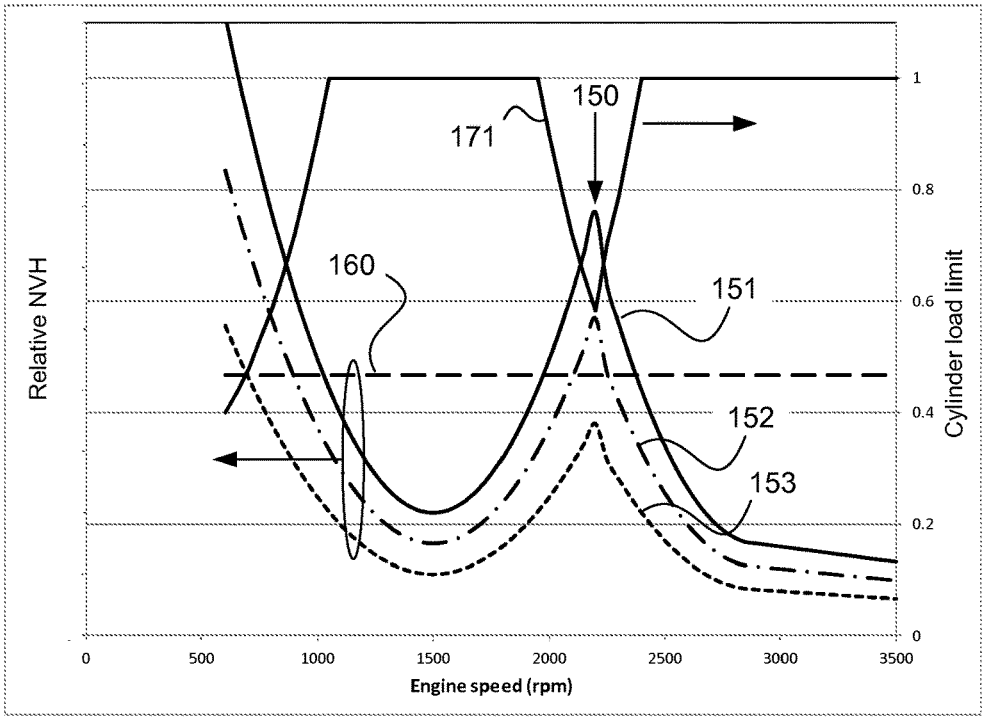
FIG. 1 is an exemplary plot of NVH versus engine speed for a selected firing frequency at various cylinder loadings and the resultant cylinder loading limit.

The present invention relates to a system for operating an internal combustion engine in a skip fire manner. More specifically, various implementations of the present invention take working chamber output into account to help determine a suitable skip fire firing frequency, firing fraction, firing pattern or firing sequence.

An internal combustion engine may be used as the power source for a motor vehicle. In vehicle applications, torque generated by the engine is transmitted to one or more of the vehicle's wheels. A power train, including a transmission having an adjustable gear ratio, is typically used to transmit the engine generated torque. Adjustment of the transmission alters the ratio between the engine rotation rate and the wheel rotation rate. During operation of a motor vehicle, a driver in the vehicle cabin typically demands a wide range of engine torque levels and engine speeds to accommodate varying driving conditions. Most vehicles in operation today operate all engine working chambers or cylinders at substantially equal load levels to accommodate these variable torque requests. That is the load on each cylinder in the engine is approximately constant, but the cylinder load goes up and down to meet the driver's torque request. For naturally aspirated spark-ignition engines, working chamber load level is adjusted primarily through use of throttling air flow into the engine. Operation in this manner is inefficient, since the working chambers are often operating far from maximum fuel efficiency conditions and throttling leads to pumping losses. Fuel efficiency can be significantly improved by operating the engine in a skip fire fashion where some working chambers are operating closer to optimum fuel efficiency and the remaining working chambers are deactivated.

In general, skip fire engine control contemplates selectively skipping the firing of certain cylinders during selected firing opportunities. Thus, for example, a particular cylinder may be fired during one firing opportunity and then may be skipped during the next firing opportunity and then selectively skipped or fired during the next. This is contrasted with conventional variable displacement engine operation in which a fixed set of the cylinders are deactivated during certain low-load operating conditions.

One challenge with skip fire engine control is reducing undesirable noise, vibration and harshness (NVH) to an acceptable level. The noise and vibration produced by the engine can be transmitted to occupants in the vehicle cabin through a variety of paths. Some of these paths, for example the drive train, can modify the amplitude of the various frequency components present in the engine noise and vibration signature. Specifically, lower transmission gear ratios tend to amplify vibrations, since the transmission is increasing the torque and the torque variation at the wheels. The noise and vibration can also excite various vehicle resonances, which can then couple into the vehicle cabin.

Some noise and vibration frequencies can be particularly annoying for vehicle occupants. In particular, low frequency, repeating patterns (e.g., frequency components in the range of 0.2 to 8 Hz) tend to generate undesirable vibrations perceived by vehicle occupants. The higher order harmonics of these patterns can cause noise in the passenger cabin. In particular, a frequency around 40 Hz may resonate within the vehicle cabin, the so called "boom" frequency. Commercially viable skip fire engine control requires operating at an acceptable NVH level while simultaneously delivering the driver desired or requested engine torque output and achieving significant fuel efficiency gains.

The NVH characteristics vary with the engine speed, firing frequency, and transmission gear. For example, consider an engine controller that selects a particular firing frequency that indicates a percentage of firings necessary to deliver a desired torque at a particular engine speed and gear. Based on the firing frequency, the engine controller generates a repeating firing pattern to operate the working chambers of the engine in a skip fire manner. As is well known by those familiar in the art, at a given engine speed an engine that runs smoothly with some firing patterns may generate undesirable acoustic or vibration effects with other firing patterns. Likewise, a given firing pattern may provide acceptable NVH at one engine speed, but the same pattern may produce unacceptable NVH at other engine speeds. Engine induced noise and vibration is also affected by the cylinder load or working chamber output. If less air and fuel is delivered to a cylinder, the firing of the cylinder will generate less output, as well as less noise and vibration. As a result, if the cylinder output is reduced, some firing frequencies and sequences that were unusable due to their poor NVH characteristics may then become usable.

This concept is depicted graphically in FIG. 1, which shows an exemplary plot of NVH versus engine speed for a selected firing frequency and various cylinder loadings for a fixed transmission gear ratio. FIG. 1 shows a set of three curves, 151, 152 and 153, corresponding to different values of cylinder loading. Curve 151 corresponds to the maximum cylinder loading, while curves 152 and 153 correspond to successively lower cylinder loading values. The cylinder loading may be defined by the cylinder torque fraction (CTF), which gives an indication of a working chamber output relative to a reference value. For example, the CTF values may be relative to the maximum possible output torque generated by a working chamber with wide open throttle at a reference ambient pressure and temperature, i.e. 100 kPa and 0 C, and the appropriate valve and sparking timing. Of course, other ranges and references values may be used. In this application CTF is generally a value between 0 and 1.0, although it may be greater than 1 in some circumstances, such as low ambient temperatures and/or operation below sea level or in boosted engines, i.e. engines with a supercharger or turbocharger. As shown in FIG. 1 lower levels of cylinder loading produce lower NVH, but the shape of the NVH curve is essentially constant for any fixed firing frequency and transmission gear ratio. In general, NVH is higher at low engine speeds because low engine speeds tend to generate vibration in the 0.2 to 8 Hz frequency range, which is particularly unpleasant to vehicle occupants. In addition, to high NVH at low engine speeds one or more resonances 150 in the NVH signature may be present at higher engine speeds. These peaks may correspond to the excitation of the cabin boom frequency or other resonances within the vehicle.

Also, shown in FIG. 1 is an acceptable NVH limit 160. This limit is shown as having a single, constant value for all engine speeds and driving conditions; however, as described below this need not be the case. In this example, the operating region below the NVH limit 160 represents a region of acceptable operating points from an NVH perspective, while regions above the NVH limit are excluded operating points. FIG. 1 also displays the cylinder load limit 171 as a function of engine speed. Curve 171 can be readily generated by comparing the NVH produced at each cylinder load and engine speed with the acceptable NVH limit Inspection of the graph indicates that CTF values of 1, curve 151, are allowed at engine speeds above approximately 1000 rpm with the exception of the band around resonance 150 where engine speeds in the range of approximately 1950 to 2350 rpm are forbidden. For the lower CTF value of curve 152 operation is allowed at engine speeds above approximately 900 rpm with the exception of the band between approximately 2050 to 2250 rpm. For the lowest CTF shown, curve 153, operation is allowed at all engine speeds above approximately 700 rpm. Even though curve 153 displays the resonance 150, the maximum NVH at the resonant frequency is still below the allowable limit. In general, results similar to that shown in FIG. 1 may be obtained for each firing frequency and transmission gear ratio. The curves may display multiple resonances at varying engine speeds having different NVH values, but all firing frequencies and transmission gear ratios will display qualitatively similar curves. Note that in a conventionally controlled engine, i.e. without skip fire, the family of curves obtained corresponds to the case of a firing frequency equal to 1.

Figure 2:
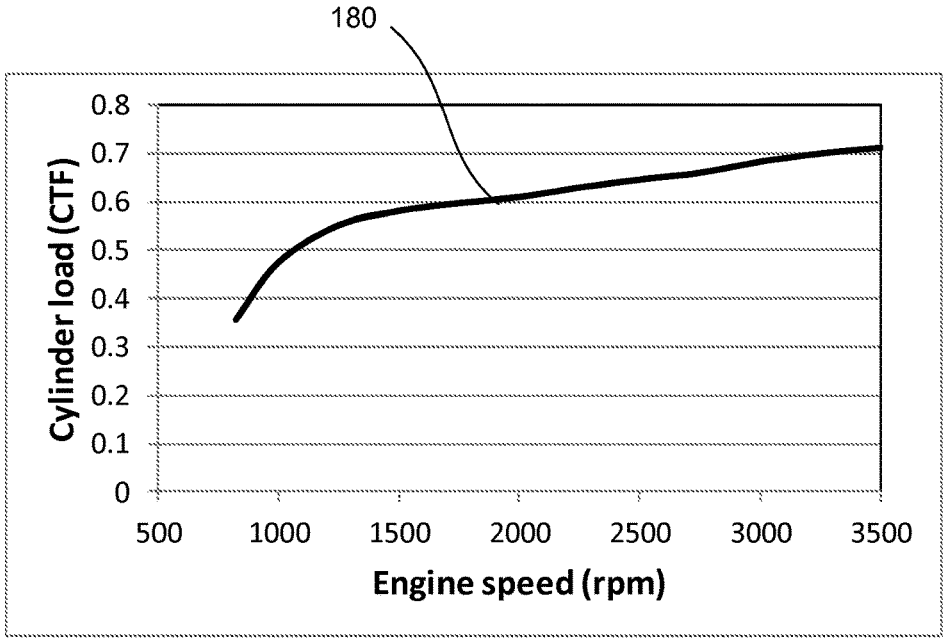
FIG. 2 is an exemplary plot of the cylinder load resulting in optimum fuel efficiency at different engine speeds.

The cylinder load can be varied by adjustment of various engine parameters, such as manifold absolute pressure (MAP), intake and exhaust valve timing, exhaust gas recirculation, and spark timing. The MAP is typically adjusted using a throttle to limit the size of the opening into the intake manifold. For engines with a cam shaft, the valve timing is adjusted using a cam phaser. Barometric pressure and ambient temperature also influence the cylinder load. For boosted engines the cylinder load may be varied by adjusting the boost level. In general, the cylinder load that provides for most efficient fuel utilization varies as a function of the engine speed. Highest fuel efficiency is typically obtained with the MAP at or near barometric pressure. The spark and cam phaser settings that yield highest fuel efficiency depend on the engine design. For each engine speed, the spark and cam phaser setting can be determined which yield the maximum fuel efficiency. The resultant optimum cylinder load that yields the highest fuel efficiency ($CTF_{opt}$) can be determined. FIG. 2 shows an exemplary graph of $CTF_{opt}$ 180 versus engine speed. In general, at low engine speed $CTF_{opt}$ is low, it increases and plateaus as the engine speed increases. At high engine speeds (not shown in FIG. 2) $CTF_{opt}$ tends to decrease. Note that $CTF_{opt}$ may vary depending on ambient conditions, such as the ambient temperature, humidity, and atmospheric pressure. Sensors located on the vehicle may detect these values and adjust $CTF_{opt}$ based on the ambient conditions. The fuel quality, measured by octane rating or some comparable metric, may also influence the $CTF_{opt}$ value.

The present application describes various engine controller implementations that take into account the above issues to provide fuel efficient operation with acceptable NVH characteristics. In some embodiments, for example, an engine controller uses a factor indicative of the engine or working chamber requested output (e.g., cylinder torque fraction, mass air charge (MAC), air per cylinder, brake torque, cylinder load, net mean effective pressure, or any other parameter related to engine or working chamber output) to help determine a firing frequency, firing fraction, pattern, sequence or other firing characteristic. Some implementations involve an engine controller that does not determine a firing frequency based on the assumption that a particular fixed or maximum amount of air needs to be delivered to each fired cylinder. Instead, the engine controller considers the possibility of different air charge or working chamber output levels when determining a firing fraction or other firing characteristic. Generally, the engine controller is arranged to avoid or select particular firing frequencies, firing fractions, firing patterns or firing sequences, depending on current or anticipated operating parameters or engine settings.

An engine controller may use a lookup table, a control algorithm, or another mechanism that takes into account differing vehicle operating parameters or conditions when determining the acceptable NVH limit. The engine controller may use a lookup table to determine an appropriate firing fraction for operating the engine, given current and/or anticipated operating parameters. These and other embodiments will be described below with reference to the figures.

A general goal of any skip fire engine controller or skip fire engine control method is to deliver the requested engine output while minimizing fuel consumption and providing acceptable NVH performance. This is a challenging problem because of the wide range of operating conditions encountered during vehicle operation. A requested engine output may be expressed as a torque request at an engine operating speed. It should be appreciated that the amount of engine torque delivered can be represented by the product of the firing frequency and the cylinder load. Thus, if the firing frequency (FF) is increased, the cylinder load (CTF) can be decreased to generate the same engine torque, and vice versa. In other words, $$\text{Engine Torque Fraction (ETF)} = CTF * FF \quad \text{(Eq. 1)}$$

where the ETF is a value that represents normalized net or indicated engine torque. In this equation all values are dimensionless, which allows it to be used with all types of engines and in all types of vehicles. That is, to deliver the same engine torque, a variety of different firing frequencies and CTF combinations may be used. Equation 1 does not include the affects of engine friction. A similar analysis could be done including friction. In this case the calculated parameter would be brake torque fraction. Either engine net torque fraction, engine brake torque fraction, engine indicated torque fraction, or some similar metric can be used as the basis of a control algorithm. For clarity the term engine torque fraction can refer to any of these measures of engine output and will be used in the subsequent discussion of engine controllers and engine control methods.

FIG. 3 shows an exemplary table 340 compiling the most fuel efficient operating firing frequency, denoted as a base firing frequency ($FF_{base}$), for a range of engine torque fractions (ETFs) and engine speeds. The firing frequency is defined as the ratio of cylinder firings relative to the firing opportunities, i.e. all cylinder operation. Each column 350 in FIG. 3 corresponds to an engine speed and each row 360 corresponds to an engine torque fraction. Each table entry 370 represents the base firing frequency, $FF_{base}$, base, which is the firing frequency that provides the most fuel efficient operation at the specified engine speed and torque request. The base firing frequency can readily be calculated using equation 1 in conjunction with knowledge of ($CTF_{opt}$) at different engine speeds (see FIG. 2). Two general trends are evident in base firing frequency behavior. First, for fixed engine speed as the engine torque request increases the base firing frequency increases to match the required load. Secondly, for a fixed ETF as the engine speed increases the base firing frequency decreases. This reflects the fact shown in FIG. 2 that the cylinder loading which provides optimum fuel efficiency tends to increase as the engine speed increases. These trends will generally be present in all internal combustion engines; however, the exact values of the base firing frequency will vary depending on details of the engine design. Entries without a value cannot deliver the requested torque at ($CTF_{opt}$), since the firing frequency cannot be greater than 1. In order to deliver these torque levels, the cylinders will need to be operated with CTF values greater than $CTF_{opt}$. However, even in these situations skip fire operation is generally more efficient than conventional engine control, since skip fire operation allows the cylinder load to more closely match $CTF_{opt}$. While it is generally advantageous for the $FF_{base}$ values in FIG. 3 to represent the most fuel efficient firing fraction to deliver the request engine torque, other criteria may be used to define $FF_{base}$.

Figure 4:
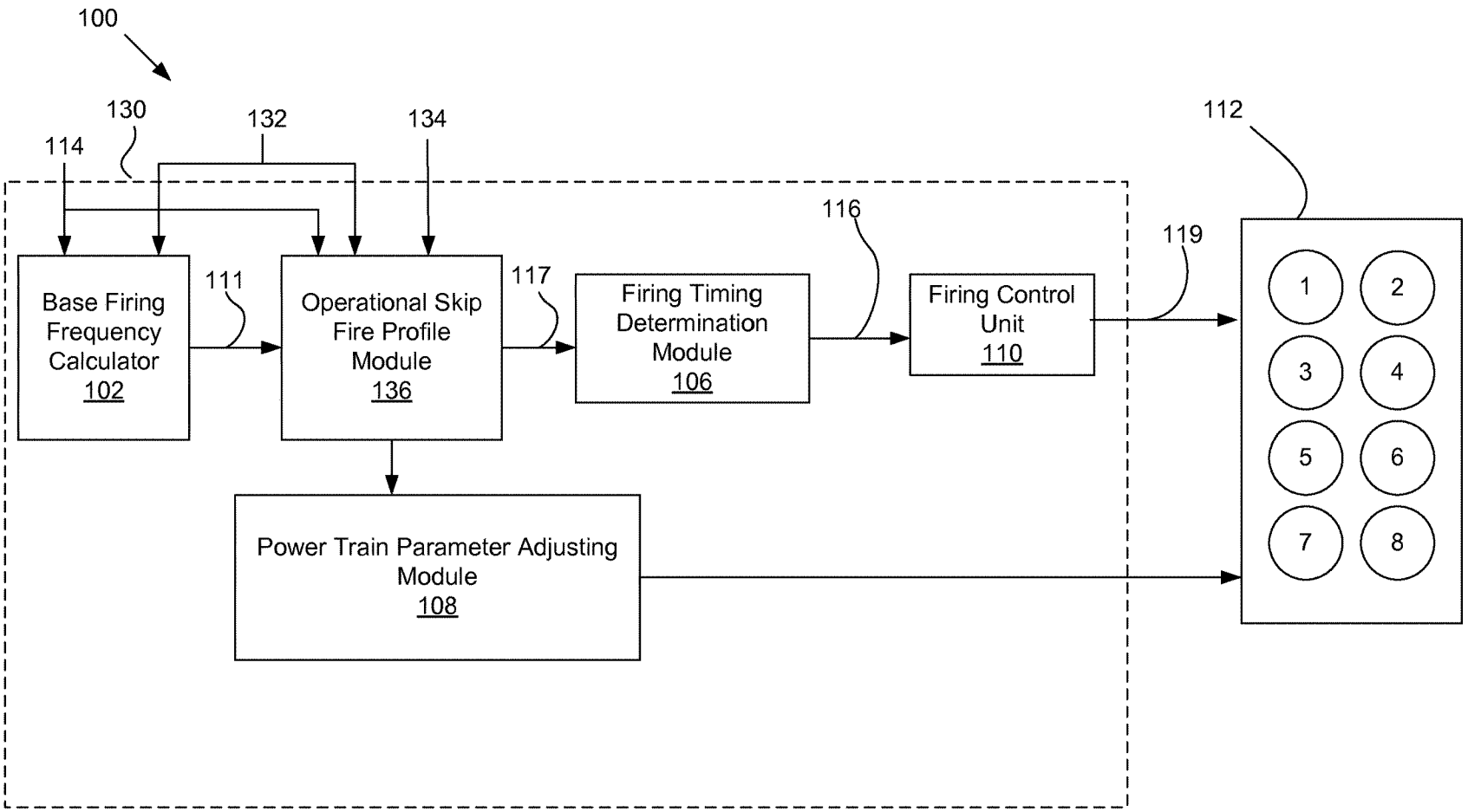
FIG. 4 is a block diagram illustrating an engine controller according to a particular embodiment of the present invention.

Referring to FIG. 4, an engine 100 according to a particular embodiment of the present invention will be described. The engine 100 consists of an engine controller 130 and the working chambers of the engine 112. The engine controller 130 receives an input signal 114 representative of the desired engine output and various vehicle operating parameters, such as an engine speed 132 and transmission gear 134. The input signal 114 may be treated as a request for a desired engine output or torque. The signal 114 may be received or derived from an accelerator pedal position sensor (APP) or other suitable sources, such as a cruise controller, a torque calculator, etc. An optional preprocessor may modify the accelerator pedal signal prior to delivery to the engine controller 130. However, it should be appreciated that in other implementations, the accelerator pedal position sensor may communicate directly with the engine controller 130. The engine controller 130 may include a base firing frequency calculator 102, an operational skip fire profile module 136, a power train parameter adjustment module 108, a firing timing determination module 106, and a firing control unit 110. The engine controller 130 is arranged to operate working chambers of the engine 112 in a skip fire manner.

The base firing frequency calculator 102 receives input signal 114 (and when present other suitable sources) and engine speed 132 and is arranged to determine a base firing frequency 111 that would be appropriate to deliver the desired output. The base firing frequency 111 is the firing frequency that delivers the requested torque at the most fuel efficient firing frequency and cylinder load as described relative to FIG. 3.

The base firing frequency 111 is input into the operational skip fire profile module 136. The operational skip fire profile is determined based at least in part on the engine speed 132 and transmission gear 134, which are both inputs to the operational skip fire profile module 136. The input signal 114 may also serve as an input to the operational skip fire profile module 136. The operational skip fire profile module 136 determines an operational skip fire profile. The operational skip fire profile includes both an operational firing fraction ($FF_{op}$) and a factor indicative of working chamber output, such as cylinder torque fraction, CTF. Other indicators of cylinder load may be used in place of cylinder torque fraction, such as brake torque, cylinder load, net mean effective pressure, air per cylinder (APC), mass air charge (MAC) or any other parameter that is related to working chamber output. In various embodiments, the determination of the operational skip fire profile is based on various operating parameters, including but not limited to engine speed, transmission gear, road conditions, driver settings, accelerator pedal position and the rate of change of the accelerator pedal position The operational skip fire profile module 136 takes into account multiple possible working chamber output levels when determining a suitable firing fraction. There are a wide variety of ways in which the operational skip fire profile module 136 can take into account different possible working chamber output levels. In some embodiments, for example, the operational skip fire profile module 136 references one or more lookup tables. The lookup tables may contain entries that indicate allowable engine speeds, cylinder loads and/or other engine parameters for particular firing fractions or frequencies (e.g, as illustrated in FIGS. 6 and 7.) One or more possible skip fire firing profiles are evaluated using the lookup tables. Each skip fire firing profile produces a desired engine torque via some combination of firing frequency and cylinder torque fraction. Some of these skip fire firing profiles will produce unacceptable NVH over certain engine speed ranges and gear settings and will be excluded from consideration as the operational skip fire profile. Among the remaining skip fire profiles the operational skip fire module 136 may advantageously select the skip fire profile having the best fuel efficiency as the operational skip fire profile. Alternatively the operational skip fire module 136 may use alternative criteria for making the determination of the operational skip fire profile.

In the illustrated embodiment shown in FIG. 4, a power train parameter adjusting module 108 is provided that cooperates with the operational skip fire profile module 136. The power train parameter adjusting module 108 directs the engine working chambers 112 to set selected power train parameters appropriately to ensure that the actual engine output substantially equals the requested engine output at the operational firing fraction. For example, if the operational skip fire profile module 136 determines that a higher firing fraction may be used, but would require the use of a lower working chamber output level or air charge, the power train parameter adjusting module would help ensure that a suitable, lower amount of air is delivered to the fired working chambers. The power train parameter adjusting module 108 may be responsible for setting any suitable engine setting (e.g., mass air charge, spark timing, cam timing, valve control, exhaust gas recirculation, throttle, etc.) to help ensure that the actual engine output matches the requested engine output.

The firing timing determination module 106 receives the operational firing fraction 117 from the operational skip fire profile module 136 and is arranged to issue a sequence of firing commands that cause the engine to deliver the percentage of firings dictated by an operational firing fraction 117. The sequence of firing commands (sometimes referred to as a drive pulse signal 116) outputted by the firing timing determining module 106 are passed to the firing control unit 110 which orchestrates the actual firings through firing signals 119 directed to the engine working chambers 112.

It should be appreciated that the engine controller 130 is not limited to the specific arrangement shown in FIG. 4. One or more of the illustrated modules may be integrated together. Alternatively, the features of a particular module may instead be distributed among multiple modules. The engine controller may also include additional features, modules or operations based on other patent applications, including U.S. Pat. Nos. 7,954,474; 7,886,715; 7,849,835; 7,577,511; 8,099,224; 8,131,445; 8,131,447; and 8,616,181; U.S. patent application Ser. Nos. 13/774,134; 13/963,686; 13/953,615; 13/953,615; 13/886,107; 13/963,759; 13/963,819; 13/961,701; 13/963,744; 13/843,567; 13/794,157; 13/842,234; 13/654,244, 13/654,248 and 13/654,244 and; and U.S. Provisional Patent Application Nos. 61/080,192; 61/104,222; and 61/640,646, each of which is incorporated herein by reference in its entirety for all purposes. Any of the features, modules and operations described in the above patent documents may be added to the illustrated engine controller 130. In various alternative implementations, these functional blocks may be accomplished algorithmically using a microprocessor, ECU or other computation device, using analog or digital components, using programmable logic, using combinations of the foregoing and/or in any other suitable manner.

Figure 5:
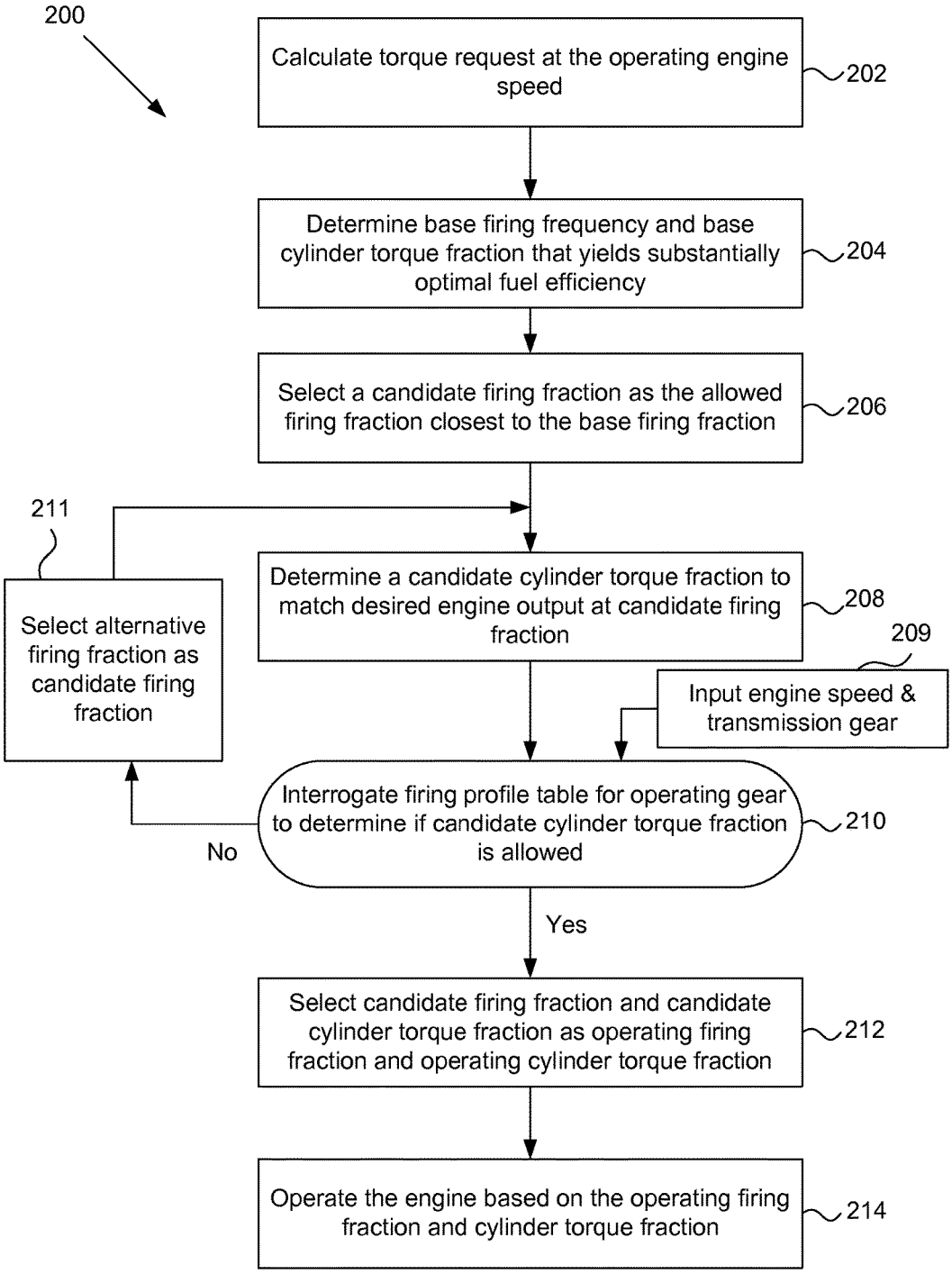
FIG. 5 is a flow diagram of a method for selecting an operational skip fire firing profile according to a particular embodiment of the present invention.

Referring next to FIG. 5, a method for determining an operational skip fire profile 200 according to a particular embodiment of the present invention will be described. The operational skip fire profile consists of an operational firing fraction and cylinder torque fraction or some equivalent measure of cylinder output. In various embodiments, the operational skip fire profile module 136 and/or the engine controller 130 perform the steps of FIG. 5.

At step 202, a torque request is determined based on input signal 114 (from FIG. 4) and the current engine operating speed. The input signal 114 is derived from any suitable sensor(s) or operating parameter(s), including, for example, an accelerator pedal position sensor.

At step 204, the base firing frequency calculator 102 determines a base firing frequency and base cylinder torque fraction. The base firing frequency and base cylinder torque fraction is the combination that yields the optimum fuel efficiency while delivering the requested torque. The operational skip fire profile module 136 then selects a candidate firing fraction from a set of available firing fractions (step 206). The candidate firing fraction may be the firing fraction closest to the base firing frequency. The operational skip fire profile module 136 then determines a candidate cylinder torque fraction from the torque request and candidate firing fraction using Eq. 1 (step 208).

The operational skip fire profile module 136 then interrogates a firing profile table to determine whether the candidate firing fraction and cylinder torque fraction are allowed (step 210). Inputs to this decision are the current engine speed and transmission gear (step 209). If the candidate torque fraction is allowed for this candidate firing fraction the process moves to step 212 where the candidate firing fraction and candidate cylinder torque request are selected as the operating firing fraction and operating cylinder torque fraction, i.e. the operational skip fire firing profile. The process then moves to step 214 where the engine is operated using the operational skip fire firing profile.

If in step 210 it is determined that the candidate cylinder torque fraction is unacceptable, the process proceeds to step 211 where a new candidate firing fraction is selected. The process then proceeds again to step 208 where the cylinder torque fraction associated with the new candidate firing fraction is calculated. A determination is then made if this new skip firing profile is acceptable (step 210). This loop proceeds until an acceptable candidate firing fraction is selected. Once this occurs the process proceeds through steps 212 and 214 as previously described.

A lookup table may be used in step 210 of FIG. 5 to determine whether the candidate cylinder torque fraction for the candidate firing fraction is allowed. FIG. 6 is a sample lookup table 300. Each row in the lookup table 300 corresponds to a particular firing fraction or firing frequency. In this example, each row indicates a maximum allowed cylinder torque fraction for a corresponding firing fraction. For any given firing fraction, the maximum allowed CTF may differ based on engine speed and/or other parameters. The rows may be arranged in ascending order from the lowest operating firing fraction, 1/9, to the highest firing fraction, 1. In table 300 all firing fractions with denominators of 9 or less are allowed. It should be appreciated that is some cases lower and higher maximum values for the firing fraction denominator may be used. Associated with each row is a maximum CTF value associated with each engine operating speed. In some cases it may be possible to provide a single CTF limit for each firing fraction without reference to the engine speed.

As an aid in understanding use of the look up table 300 shown in FIG. 6, consider a specific example of a torque request of 0.10 and an engine speed of 1000 rpm (this corresponds to the entry 370 in FIG. 3). From FIG. 3 the base firing frequency is 0.211. Interrogation of the lookup table 300 shows that the closest firing fraction to the base firing frequency is 1/5 or 0.200. This is selected as the candidate firing fraction (step 206). From equation 1 the required cylinder torque fraction may be determined as 0.1/0.200 or 0.5. The look up table 300 may then be interrogated to determine if a CTF of 0.5 is acceptable. In this case the value in the CTF limit table 372 is 0.06, so a CTF of 0.5 is unacceptable and a new candidate firing fraction must be selected as indicated in step 211. This may be done in multiple ways. One method is to increase the candidate firing fraction to the adjacent higher value, equivalent to stepping down a row in table 300, and repeating the process. In this case, the new candidate firing fraction would be 2/9 and the corresponding candidate CTF would be 0.1/(2/9) or 0.45 (step 208). Interrogation of table 300 (step 210) indicates that the appropriate maximum CTF value 373 is 0.03, so the candidate cylinder torque fraction of 0.45 is again unacceptable. The candidate firing fraction may again be incremented (step 211) and the new firing fraction is 1/3. The corresponding candidate CTF is 0.1/(1/3) or 0.3. Interrogation of table 300 (step 210) indicates that the appropriate maximum CTF value 374 is 0.51, so the candidate cylinder torque fraction of 0.3 is acceptable. The candidate firing fraction and cylinder torque fraction can then be selected as the operating firing fraction and cylinder torque fraction (step 212). The engine may be operated with this firing fraction and cylinder torque fraction (step 214).

Other search methods may be used in table 300 to determine an acceptable skip fire firing profile. For example, instead of incrementing the firing fraction to the next higher allowed firing fraction if the candidate firing fraction is unacceptable, the algorithm could move to the next closest firing fraction to the base firing frequency. This may be a smaller firing fraction than the original candidate firing fraction. Also, instead of choosing the firing fraction closest to the base firing frequency as the initial candidate firing fraction, the algorithm could select the closest firing fraction having a value greater than the base firing frequency. The search for an acceptable skip fire firing profile need not start with selecting the candidate firing fraction closest to the base firing frequency. Other search methods may be used with the goal of finding an acceptable skip fire firing profile with operating conditions at or near those that give rise to optimal fuel efficiency.

In general, acceptable skip fire firing profiles will be found by moving to higher firing fractions, since the associated cylinder torque fraction will be lower. In the extreme case the firing fraction moves to 1 and the engine operates on all cylinders, just as a conventionally controlled engine. An important advantage of various implementations of the present invention is the ability to operate the engine at an acceptable NVH at firing fractions at or close to the base firing frequency, which results in improved fuel economy.

An advantage of various embodiments of the present invention is that they take into account cylinder load and fuel efficiency in determining an acceptable firing fraction. That is, they do not necessarily assume that firing cylinders need to be operated at or near their optimal efficiency. In some cases an undesirable frequency can still be acceptable, if its amplitude is sufficiently low. Various embodiments recognize when operating at reduced cylinder loads the NVH is lower than operating at the cylinder load corresponding to optimum fuel efficiency. This allows access to firing fractions that are closer to the base firing frequency and thus yields improved fuel efficiency.

There are a variety of methods that the information displayed in table 300 (FIG. 6) may be presented and interrogated. Table 300 is a two-dimensional table with the entries corresponding to the maximum allowed CTF at any given firing fraction and engine speed for a given transmission gear. The information can alternatively be expressed as a one-dimensional table where each row of the table lists a firing fraction and maximum CTF. This means that the list of data encompassing the maximum CTF and ranges of engine speed operation can be considered to be a single entry for purposes of this description. Associated with each entry are acceptable engine operating speeds. Different tables may be constructed for each transmission gear ratio. It should be appreciated for a vehicle with a continuously variable transmission, i.e. not having fixed gear ratios, the tables can be constructed for different ranges of transmission speed ratios. FIG. 7 shows a portion of such a table 700. Each row 740 corresponds to a firing fraction and maximum allowed cylinder torque fraction. The rows may be arranged first based on firing fraction and then on cylinder torque fraction as shown in FIG. 7, although other arrangements also may be used. Each row indicates the allowable engine operation speeds associated with a particular maximum allowed CTF and a firing fraction. In table 700 the acceptable engine speeds are depicted by a series of allowed ranges. For the values shown in table 700 up to three ranges are used, although more ranges and fewer ranges may be used in some cases. Alternatively, other methods of representing the allowed engine speeds may be shown. Generally as the CTF level decreases the allowable range of engine speeds increases, since the energy associated with each firing is reduced. Conversely, the allowed speed range narrows as the CTF is increased for a fixed firing fraction. This is consistent with the physical model shown in FIG. 1. In table 700 some engine speed range is acceptable for all listed firing fractions; however, in some situations a firing fraction may have no allowed engine speeds. For example, some firing fractions may be excluded when operating in a certain transmission gear.

The selection of an operational skip fire firing profile and/or corresponding firing fraction may be performed in a wide variety of ways. In various implementations, for example, a linear search or algorithm is used to navigate a lookup table to determine a suitable profile. In the lookup table 700 of FIG. 7, for example, the following algorithm may be used to find a suitable skip fire firing profile/firing fraction:

1) Start in the top row of the table.

2) Move to the next row until the firing fraction is larger than the base firing frequency.

3) In that row, look at the CTF limit column. If the value in the CTF limit column is smaller than the candidate CTF, go to step 4. Otherwise, repeat step 2.

4) If the current engine speed is outside of the allowed operating ranges in table 700, move to the next row and repeat step 3. Otherwise, stop here. The candidate firing fraction and corresponding cylinder torque fraction yield acceptable NVH performance while maximizing fuel efficiency. These conditions represent the operational skip fire firing profile. Note that under any condition, the row corresponding to a firing fraction of 1 is acceptable, so the search always ends successfully.

In various embodiments, the rows of the table are analyzed in the order of low-to-high firing fractions. That is, if the current operating conditions do not provide acceptable NVH performance, the operational skip fire profile module 136 then moves on to the row for the next highest firing fraction. A determination is again made as to whether the current operating parameters meet the acceptable NVH criteria, and the process continues until a suitable firing fraction is found and/or all the available profiles have been considered, which would revert engine operation to a firing fraction of 1. As a result, in some implementations, operational skip fire profile module 136 selects the operational skip fire firing profile with the lowest firing fraction that meets the following criteria: 1) the profile is suitable for delivering the desired torque; and 2) the current or anticipated operating parameters provide acceptable NVH performance for the selected firing fraction.

Once operational skip fire profile module 136 has selected a suitable operational skip fire firing profile, the firing timing determination module 106 (from FIG. 4) generates a firing sequence based on the selected profile (step 210 of FIG. 5). In some embodiments, for example, each profile corresponds to an available firing fraction. This operational firing fraction 117 is then received by the firing timing determination module 106. The firing timing determination module generates a firing sequence 116, which is sent to the firing control unit 110 based on the operational firing fraction 117. The firing control unit 110 in turn directs the working chambers of the engine 112 to operate in a skip fire manner based on the firing sequence 119.

In addition to presenting the acceptable skip fire firing profiles in a one-dimensional table like table 700 and a two-dimensional table like table 300, the acceptable profiles may also be compiled in a three dimensional table that lists engine speed, transmission gear, and firing fraction as the variables and maximum CTF as the table entry. This table contains information on which cylinder loads are allowed for each firing fraction, transmission gear setting, and engine speed. Similar tables can be constructed using different variables, but can provide substantially the same information, i.e. acceptable skip fire firing profiles for different vehicle operating conditions.

It should be appreciated that the lookup tables in the figures are only for illustrative purposes and that the concept of determining acceptable skip fire firing profiles may be implemented in a wide variety of ways. The format and structure of the data, the number of entries, the inputs to the lookup table, the number of lookup tables and the values in the lookup table can, of course, be modified to suit the needs of different applications. Generally, the data from the aforementioned tables can be stored in or involve any suitable mechanism, data structure, software, hardware, algorithm or lookup table that indicates or represents usage constraints for particular types of firing-related operations, characteristics or firing fractions.

In particular in some embodiments an operational skip fire profile may be determined without first determining a base firing frequency. In this case, a number of candidate skip fire profiles may be considered by the operational skip fire profile module 136 that deliver the requested torque. The operational skip fire profile module 136 may then select from these candidate skip fire profiles based on multiple criteria; including, but not limited to, NVH and fuel efficiency.

Figure 8:
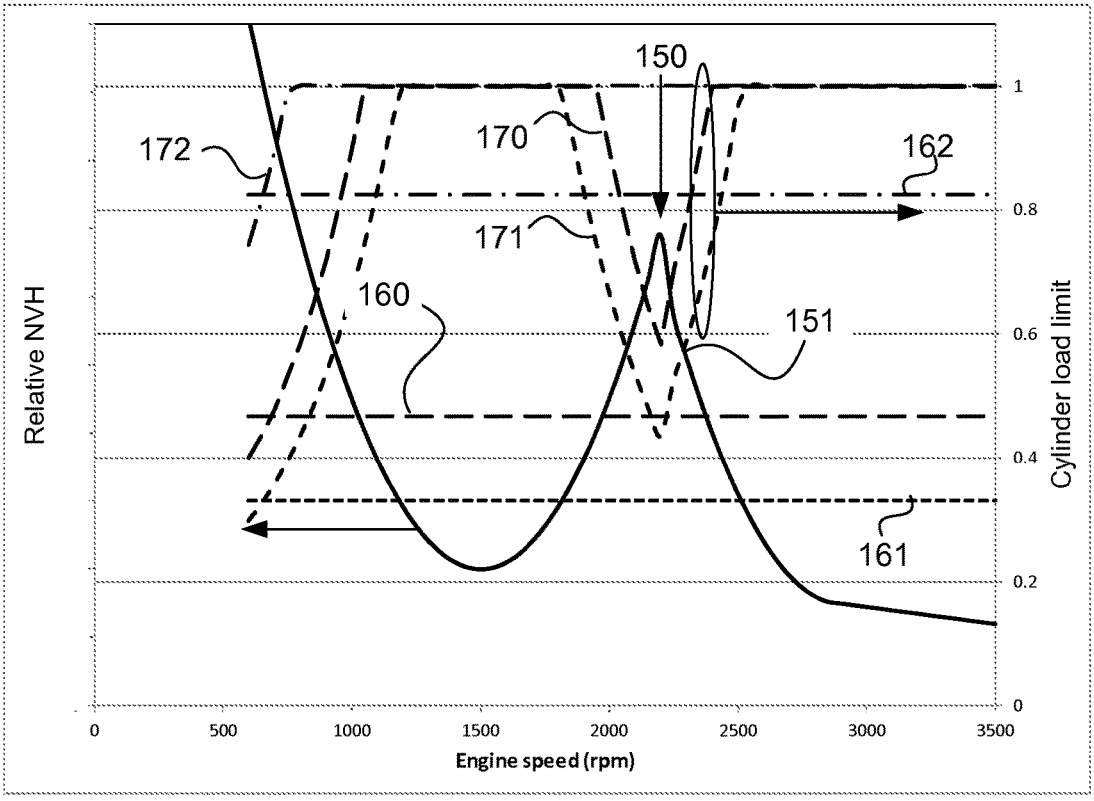
FIG. 8 is an exemplary plot of NVH versus engine speed for a selected firing frequency at maximum cylinder load and the resultant cylinder loading limits associated with various acceptable NVH levels.

In additional embodiments of the present invention multiple levels of acceptable NVH may be used. Selection of the appropriate NVH level may depend on many conditions such as a vehicle operating parameter, road roughness, cabin noise level, and/or user preference. FIG. 8 graphically depicts this embodiment. FIG. 8 is similar to FIG. 1 with the horizontal axis being engine speed, the left vertical axis being NVH level and the right vertical axis being the maximum acceptable cylinder load. As in FIG. 1 curve 151 corresponds to the maximum cylinder loading, i.e. CTF=1. Curve 151 has a resonance 150 at an engine speed of approximately 2200 rpm. In this case there are three different acceptable levels of NVH corresponding to curves 160, 161, and 162. Curve 161 corresponds to the most restrictive NVH criteria. Curve 162 corresponds to the least restrictive NVH criteria. Curve 160 corresponds to intermediate NVH criteria. Associated with the different acceptable NVH levels are the corresponding maximum cylinder loading limits. For the least restrictive NVH criteria, curve 162, the resulting maximum cylinder load curve is 172. In this case the engine is allowed to operate at maximum cylinder load for all engine speeds, except low speeds below approximately 750 rpm. For the most restrictive NVH criteria, curve 161, the corresponding maximum cylinder load curve is 171. In this case there are two ranges of engine speeds where operation at maximum CTF is allowed. The first range is between approximately 1150 and 1750 rpm and the second range is above 2500 rpm. At the intermediate NVH level of curve 160, the resulting maximum cylinder load limit curve is 170. This is the same case described in relation to FIG. 1. While FIG. 8 shows the acceptable NVH level in all cases to be independent of engine speed, this is not necessarily the case. For example, higher NVH levels may be acceptable at high engine speeds.

Figure 9:
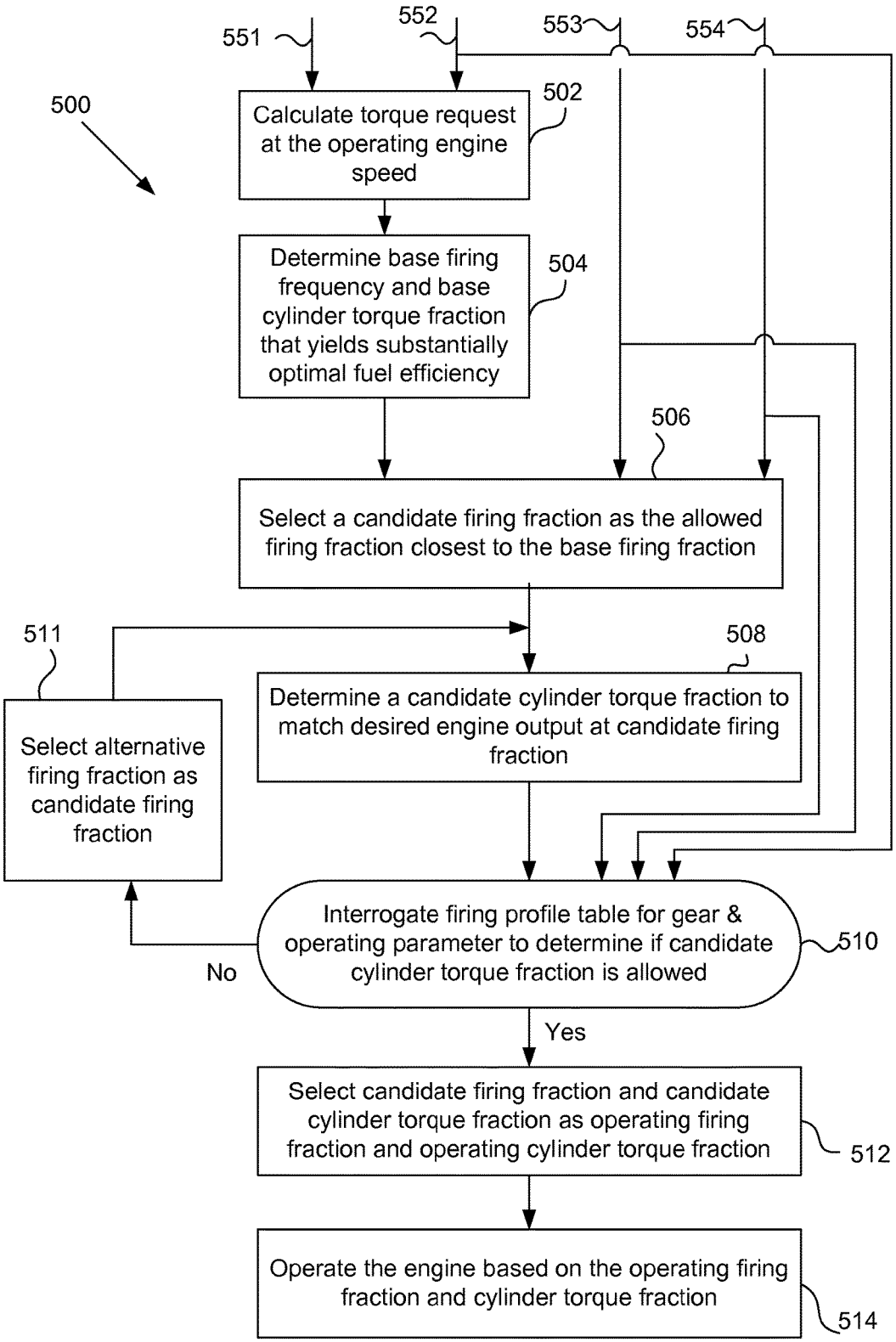
FIG. 9 is a flow diagram of a method for selecting an operational skip fire firing profile according to a particular embodiment of the present invention.

Referring next to FIG. 9, a method 500 for determining a skip fire firing profile according to the embodiment discussed relative to FIG. 8 will be described. The method 500 involves using one or more operating parameters to determine what constitutes an acceptable NVH level. This level can vary depending on the operating parameters, and thus the acceptable skip fire firing profiles may also vary.

In some situations, it is desirable to use more or less restrictive NVH criteria. The degree of restrictiveness may depend on the rate and direction of the accelerator pedal position change. Less restrictive NVH criteria may be applied when the pedal is tipped in and more restrictive criteria applied when the pedal is tipped out. Aggressive tip in indicates that the driver is rapidly demanding increasing torque from the engine and under these conditions acceptable NVH criteria may be relaxed. The degree of restrictiveness may also depend on or be affected by a wide variety of detected conditions e.g., when a shift between gears is detected, vehicle speed, road conditions, or when it is determined that the engine is in idle. Additionally, the criteria may depend on factors other than those associated with the engine power train, such as the roughness of the road or noise level in the vehicle cabin. In some cases the level of acceptable NVH may be selectable by the vehicle driver. The driver may make a tradeoff between the acceptable NVH level and fuel economy.

The illustrated method 500 provides one example implementation of the above approach. The illustrated method is similar to that described in relation to FIG. 5, with the exception of adding an operating parameter input that causes different look up tables or control algorithms to be used to determine acceptable skip fire firing profiles.

Inputs to the method 500 include a driver torque request or equivalent 551, an engine speed 552, a transmission gear 553, and a vehicle or user determined operating parameter 554.

At step 502, a torque request is determined based on torque request 551 and the current engine operating speed 552.

At step 504, a base firing frequency and base cylinder torque fraction are determined. The base firing frequency and base cylinder torque fraction is the combination that yields the optimum fuel efficiency while delivering the requested torque.

At step 506, a candidate firing fraction is selected from a set of available firing fractions. The available firing fractions may depend on the transmission gear setting 553 and the vehicle operating parameter 554. The vehicle operating parameter 554 may be any parameter that helps determine whether less or more restrictive NVH criteria should be used (e.g., the rate and direction of accelerator pedal position change, etc.)

At step 508 a candidate cylinder torque fraction is determined that would result in the engine producing the desired torque at the candidate firing fraction. The operational skip fire profile module 136 (FIG. 4) then determines a candidate cylinder torque fraction from the torque request and candidate firing fraction using Eq. 1. At step 510 a firing profile table is interrogated to determine whether the candidate firing fraction and cylinder torque fraction are allowed. The values (e.g., maximum CTF values, etc.) in the table, whose format and usage may resemble table 300 of FIG. 6 and table 700 of FIG. 7, may differ depending on the operating parameter 554. Inputs to the determination at step 510 are the current engine speed 552, transmission gear 553, and vehicle parameter 554. If the candidate torque fraction is allowed, the process moves to step 512 where the candidate firing fraction and candidate cylinder torque request are selected as the operating firing fraction and operating cylinder torque fraction, i.e. the operational skip fire firing profile. The process then moves to step 514 where the engine is operated using the operational skip fire firing profile.

If in step 510 it is determined that the candidate cylinder torque profile is unacceptable, the process proceeds to step 511 where a new candidate firing fraction is selected. The process then proceeds again to step 508 where the cylinder torque fraction associated with the new candidate firing fraction is calculated. A determination is then made if this new skip firing profile is acceptable (step 510). This loop proceeds until an acceptable candidate firing fraction is selected. Once this occurs the process proceeds through steps 512 and 514 as previously described.

Figure 10:
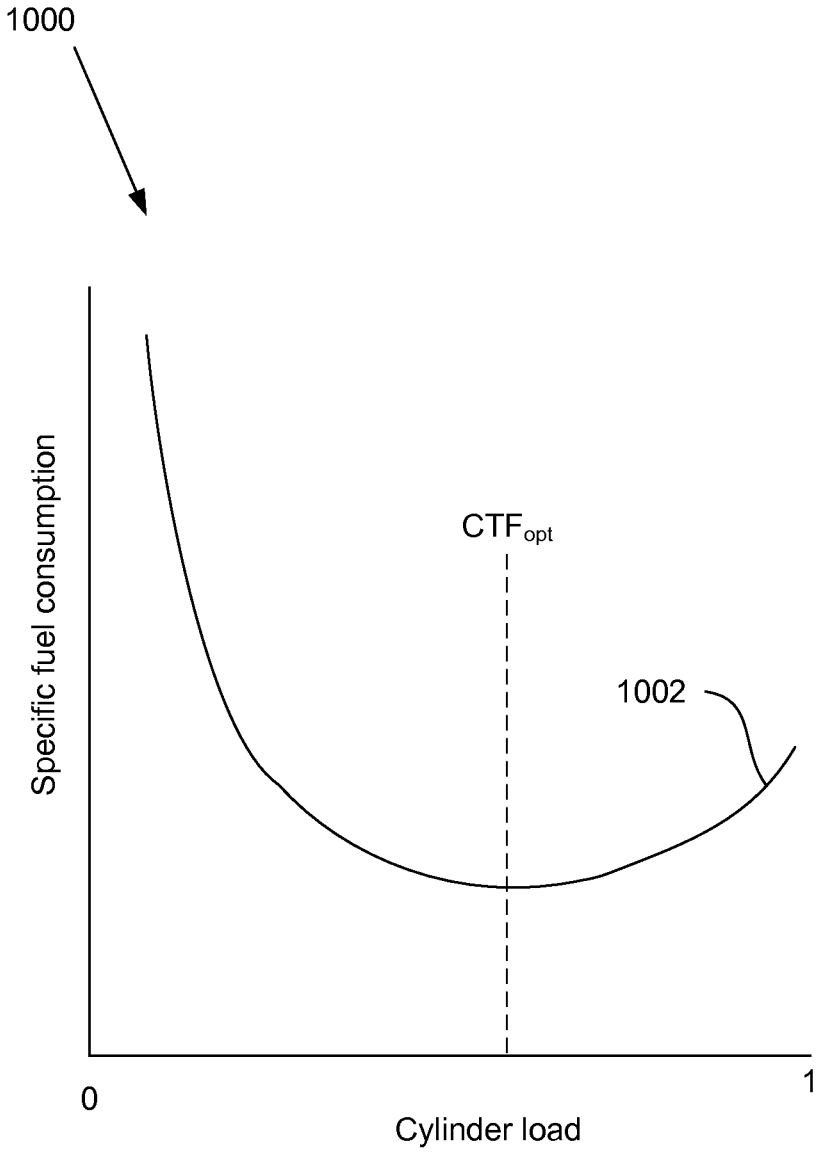
FIG. 10 is a graph indicating a relationship between specific fuel performance and cylinder load according to a particular embodiment of the present invention.

Referring next to FIG. 10, a graph 1000 indicating a relationship between cylinder load and fuel consumption according to a particular embodiment of the present invention will be described. The vertical axis for the graph 1000 corresponds to specific fuel consumption. The lower the specific fuel consumption, the greater the fuel efficiency. The horizontal axis for the graph 1000 corresponds to cylinder load. The optimally fuel efficient CTF level is indicated by a point on the curve 1002 that is labeled as $CTF_{opt}$. The curve 1002 assumes a particular engine speed and may vary as the engine speed changes. Other factors such as fuel quality, atmospheric pressure, ambient temperature and other external factors may influence curve 1002.

Some implementations of the present invention involve storing data indicated by the graph 1000 in a data structure at an engine controller 130. This cylinder load/fuel consumption data may be stored in any suitable data structure, including but not limited to a lookup table. The cylinder load/fuel consumption data may be provided for a wide range of engine speeds. The cylinder load/fuel consumption data helps indicate fuel usage or efficiency, given a particular engine speed, cylinder load and/or other engine parameter. The engine controller 130 may use the information on fuel efficiency stored in the look up table to determine the most fuel efficient operational skip fire firing profile.

The data may be used in a wide variety of ways. In some embodiments, for example, multiple candidate firing fractions are selected. A candidate cylinder load is calculated for each of the candidate firing fractions such that each cylinder load-firing fraction combination delivers a desired engine output. The aforementioned cylinder load/fuel consumption data is then used to determine which of these combinations is the most fuel efficient. The most fuel efficient combination or skip fire firing profile is then used in operating the engine. In some embodiments, for example, the firing fraction selected in this manner is used as the base firing fraction, as described in step 204 of FIG. 5.

Any and all of the described components may be arranged to refresh their determinations/calculations very rapidly. In some preferred embodiments, these determinations/calculations are refreshed on a firing opportunity by firing opportunity basis although, that is not a requirement. In some embodiments, for example, the selection of an operational skip fire firing profile (e.g., step 212 of FIG. 5 or step 512 of FIG. 9) is performed on a firing opportunity by firing opportunity basis. An advantage of firing opportunity by firing opportunity control of the various components is that it makes the engine very responsive to changed inputs and/or conditions. Although firing opportunity by firing opportunity operation is very effective, it should be appreciated that the various components can be refreshed more slowly while still providing good control (e.g., the firing fraction determinations may be performed every revolution of the crankshaft, every two or more firing opportunities, etc.).

Aside from NVH considerations other considerations may influence the choice of an acceptable operational skip fire firing profile. For example, in some cases it may be desirable to decrease the intake manifold pressure for a period of time to supply vacuum for various vehicle components, such as the power brakes. In this case operation at the skip fire firing profile which provides for optimum fuel efficiency would be prohibited, since it would not draw significant manifold vacuum. Different look up tables or a different search algorithm could be used to determine the skip fire firing profile which satisfies this intake manifold pressure constraint while simultaneously maximizing fuel economy. Similarly in the event of persistent engine knocking or malfunction of a given cylinder, different skip fire firing profiles may be used which substantially eliminate the engine knocking or avoid use of the malfunctioning cylinder.

It should be appreciated that the allowable firing fractions listed in table 600 and table 700 may be different for different gears, vehicle parameters, and driving conditions. For example less restrictive NVH constraints may allow more firing fractions than more restrictive NVH constraints. Also, not all combinations of numerator and denominator need to be included in a table. For example, in some situations 1/9 may be the only allowed firing fraction with a denominator of 9. Judicious choice of the allowable firing fractions may result in a more uniform distribution of allowed firing fraction.

The invention has been described primarily in the context of operating a naturally aspirated, 4-stroke, internal combustion piston engines suitable for use in motor vehicles. However, it should be appreciated that the described applications are very well suited for use in a wide variety of internal combustion engines. These include engines for virtually any type of vehicle—including cars, trucks, boats, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles. Boosted engines, such as those using a supercharger or turbocharger may also be used. In this case the maximum cylinder load may correspond to the maximum cylinder air charge obtained by boosting the air intake.

It should be also appreciated that any of the operations described herein may be stored in a suitable computer readable medium in the form of executable computer code. The operations are carried out when a processor executes the computer code. Such operations include but are not limited to any and all operations performed by the firing fraction calculator 102, the firing timing determination module 106, the firing control unit 110, the power train parameter adjusting module 108, operational skip fire profile module 136, the engine controller 130, or any other module, component or controller described in this application.

Although only a few embodiments of the invention have been described in detail, it should be appreciated that the invention may be implemented in many other forms without departing from the spirit or scope of the invention. There are several references to the term, firing fraction. It should be appreciated that a firing fraction may be conveyed or represented in a wide variety of ways. For example, the firing fraction may take the form of a firing pattern, sequence or any other firing characteristic that involves or inherently conveys the aforementioned percentage of firings. There are also several references to the term, "cylinder." It should be understood that the term cylinder should be understood as broadly encompassing any suitable type of working chamber. Therefore, the present embodiments should be considered illustrative and not restrictive and the invention is not to be limited to the details given herein.

What is claimed is:

1. A skip fire engine controller arranged to direct operation of an engine in a skip fire manner to deliver a desired engine output, the skip fire engine controller comprising:

a skip fire profile determination unit arranged to determine an operational firing fraction for delivering the desired engine output, wherein the skip fire profile determination unit is arranged to select the operational firing fraction from among a plurality of candidate firing fractions that are each capable of delivering the desired engine output, each of the plurality of candidate firing fractions having a corresponding maximum allowable cylinder load, wherein each of the corresponding maximum allowable cylinder loads indicates a maximum allowable cylinder torque fraction when the engine is operating at the associated one of the plurality of candidate firing fractions under specified operating conditions, wherein the maximum allowable cylinder torque fraction for at least some of the plurality of candidate firing fractions at some specified operating conditions is less than one, each of the plurality of candidate firing fractions having an associated maximum allowable engine output that is attainable by operating the engine at such candidate firing fraction at the associated maximum allowable cylinder load, wherein at a selected engine speed, the maximum allowable engine output for a first one of the candidate firing fractions is higher than the maximum allowable engine output for a second one of the candidate firing fractions, the second one of the candidate firing fractions being higher than the first one of the candidate firing fraction, and wherein the operational firing fraction is selected at least partially based on the corresponding maximum allowable cylinder load not being exceeded when the engine is firing at the operational firing fraction and operating at the desired engine output; and a firing control unit arranged to direct firings of cylinders of the engine in the skip fire manner in accordance with the operational firing fraction, the operational firing fraction resulting in the desired engine output of the engine without exceeding the maximum allowable cylinder load associated with the operational firing fraction.

2. The skip fire engine controller as recited in claim 1 wherein:

the selection of the operational firing fraction is based in part on determining which of the plurality of candidate firing fractions is more fuel-efficient.

3. The skip fire engine controller as recited in claim 1 wherein:

the selection of the operational firing fraction involves using a lookup table that indicates the maximum allowable cylinder loads for different engine speeds and firing fractions respectively.

4. The skip fire engine controller as recited in claim 1, wherein the skip fire profile determination unit is further arranged to:

calculate a cylinder load necessary to deliver the desired engine output at a selected one of the plurality of candidate firing fractions;

determine whether the calculated cylinder load exceeds or is below the corresponding maximum allowable cylinder load associated with the selected candidate firing fraction; and determine if the selected candidate firing fraction is the operational firing fraction based on if the calculated cylinder load is below the corresponding maximum allowable cylinder load.

5. The skip fire engine controller as recited in claim 1 wherein the selection of the operational firing fraction is based at least in part on one or more parameters selected from a group of parameters consisting of operating gear, gear shift, vehicle speed, presence of engine idle, accelerator pedal position and rate of change in a position of an accelerator pedal.

6. The skip fire engine controller as recited in claim 1 wherein the selection of the operational firing fraction is either:

(a) dynamically performed on a firing opportunity by firing opportunity basis; or (b) dynamically performed at least once every engine cycle.

7. The skip fire engine controller as recited in claim 1 wherein the maximum allowable cylinder load for the operational firing fraction yields relatively less NVH compared to a maximum possible cylinder load for the operational firing fraction.

8. A skip fire engine controller comprising:

a lookup table embodied in a tangible computer readable media, the lookup table including a plurality of table entries that indicate maximum allowable cylinder load thresholds at different firing fractions respectively, wherein each maximum allowable cylinder load threshold indicates a maximum allowable cylinder torque fraction when an engine is operating at the associated firing fraction of the different firing fractions under specified operating conditions, and wherein the maximum allowable cylinder torque fraction for at least some of the firing fractions at some specified operating conditions is less than one;

a skip fire profile determination unit arranged to determine an operational firing fraction suitable for delivering a requested engine output for the engine, wherein the skip fire profile determination unit utilizes the lookup table to select the operational firing fraction from among a plurality of candidate firing fractions, the operational firing fraction being selected at least partially based on a candidate cylinder load for the candidate firing fraction selected as the operational firing fraction not exceeding the maximum allowable cylinder load threshold associated with the selected candidate firing fraction when the engine is delivering the requested engine output and operating at the operational firing fraction, wherein the skip fire profile determination unit is arranged to determine the candidate cylinder load for at least the selected candidate firing fraction and to compare such candidate cylinder load to the maximum allowable cylinder load threshold associated with the selected candidate firing fraction in the determination of the operational firing fraction; and a firing control unit arranged to direct firings of cylinders of the engine in a skip fire manner in accordance with the operational firing fraction; and wherein the maximum allowable cylinder load thresholds in the lookup table are set such that at a selected engine speed, a maximum allowable engine output for a first one of the candidate firing fractions is higher than a maximum allowable engine output for a second one of the candidate firing fractions, the second one of the candidate firings fraction being higher than the first one of the candidate firing fractions.

9. The skip fire engine controller as recited in claim 8 wherein an index for the lookup table is based on firing fraction.

10. The skip fire engine controller as recited in claim 8 wherein: the determination of the operational firing fraction is based at least in part on a base firing fraction and the skip fire engine controller further comprises a base firing fraction calculator that indicates the base firing fraction that is substantially optimally fuel efficient for a given engine speed and engine output.

11. The skip fire engine controller as recited in claim 8 wherein:

the skip fire profile determination unit is further arranged to select the operational firing fraction from the plurality of candidate firing fractions in the lookup table by:

(i) accessing the lookup table to find a first firing fraction that is closest to a base firing fraction, the base firing fraction being an optimally fuel efficient firing fraction;

(ii) determining if the calculated cylinder load for the first firing fraction exceeds or falls below the maximum allowable cylinder load threshold for the first firing fraction; and then either:

(a) selecting the first firing fraction as the operating firing fraction if the calculated cylinder load falls below the maximum allowable cylinder load threshold for the first firing fraction; or (b) stepping to a next firing firing fraction in the table if the calculated cylinder load for the first firing fraction exceeds the maximum allowable cylinder load threshold for the first firing fraction; and (c) successively repeating, as needed, (a) and (b) for the next firing fraction(s) until the calculated cylinder load for one of the next firing fraction(s) falls below the maximum allowable cylinder load threshold for the one of the next firing fraction(s).

12. The skip fire engine controller as recited in claim 8 wherein at least some values in the lookup table are different based on at least one selected from the group consisting of gear shift, vehicle speed, presence of engine idle, accelerator pedal position and rate of change in a position of an accelerator pedal.

13. The skip fire engine controller as recited in claim 8 wherein:

the lookup table is one dimensional; and the specified operating conditions is a vehicle parameter selected from the group consisting of engine speed, transmission gear, and firing fraction.

14. The skip fire engine controller as recited in claim 8 wherein:

the lookup table is two dimensional; and the specified operating conditions is two vehicle parameters selected from the group consisting of engine speed, transmission gear, and firing fraction.

15. The skip fire engine controller as recited in claim 8 wherein:

the lookup table is three dimensional; and the specified operating conditions include firing fraction, a range of engine speeds and a transmission gear.

16. A method of selecting an operational skip fire firing fraction suitable for use in operating an internal combustion engine in a skip fire manner to produce a desired engine output, the method comprising, during operation of the internal combustion engine:

determining the desired engine output;

calculating a candidate cylinder load for each of a plurality of candidate firing fractions that are each capable of delivering the desired engine output, wherein each candidate cylinder load represents a cylinder torque fraction at which an associated cylinder would need to operate at an associated candidate firing fraction of the plurality of candidate firing fractions in order to deliver the desired engine output;

for each of the candidate firing fractions, determining whether the calculated candidate cylinder load exceeds a maximum allowable cylinder load associated with such candidate firing fraction under selected current engine operating conditions, wherein the maximum allowable cylinder load indicates a maximum allowed cylinder torque fraction when the internal combustion engine is operating at the associated candidate firing fraction under specified operating conditions, and wherein the maximum allowable cylinder load for at least some of the candidate firing fractions at some specified operating conditions is a cylinder torque fraction that is less than one;

eliminating one or more of the candidate firing fractions for which the associated candidate cylinder load exceeds the maximum allowable cylinder load under the selected current engine operating conditions, and after the eliminating step, selecting one of the candidate firing fractions that has not been eliminated as the operational skip fire firing fraction; and operating the internal combustion engine in the skip fire manner using the selected operational skip fire firing fraction, wherein at least some of the time, the selected operational skip fire firing fraction has an associated maximum allowable cylinder load that corresponds to a cylinder torque fraction that is less than one when operated to deliver the desired engine output under the selected current engine operating conditions.

17. The method as recited in claim 16 further comprising:

determining which of the candidate firing fractions is most fuel efficient in delivering the desired engine output wherein the selection of the operational skip fire firing fraction is based on the determination of which of the candidate firing fractions is the most fuel efficient.

18. The method as recited in claim 16 wherein:

the plurality of candidate firing fractions includes a first candidate firing fraction;

calculating a first candidate cylinder load such that a combination of the first candidate firing fraction and the first candidate cylinder load delivers the desired engine output and forms a first candidate skip fire firing fraction; and determining whether the first candidate skip fire firing fraction is allowed wherein the allowance of the first candidate skip fire firing fraction depends in part on whether the first candidate cylinder load exceeds the maximum allowed cylinder torque fraction associated with the first candidate firing fraction, wherein the maximum allowed cylinder torque fraction associated with the first candidate firing fraction varies as a function of engine speed and transmission gear.

19. The method as recited in claim 18 wherein the threshold further varies based on a vehicle operating parameter that is selected from the group consisting of operating gear, gear shift, vehicle speed, presence of engine idle, accelerator pedal position and rate of change in a position of an accelerator pedal.

20. The method as recited in claim 18 wherein:

if the first candidate skip fire firing fraction is not allowed, selecting a new candidate firing fraction and iterating until an allowed skip fire firing fraction is found.

21. An engine controller configured to control an engine to operate in a skip fire manner, the engine controller configured to:

maintain a table including a plurality of cylinder load thresholds indexed by a plurality of different operational firing fractions and engine speeds respectively;

receive an input signal representative of a desired output of the engine;

select an operational firing fraction from the table, among a plurality of candidate firing fractions, the selected operational firing fraction resulting in a cylinder load that does not exceed a cylinder load threshold of the plurality of cylinder load thresholds associated with the selected operational firing fraction for the engine operating at the selected operational firing fraction and the desired output of the engine; and cause the firing of cylinders of the engine in the skip fire manner in accordance with the selected operational firing fraction, the selected operational firing fraction resulting in an engine output substantially meeting the desired output of the engine while maintaining the cylinder load below the cylinder load threshold; and wherein the cylinder load thresholds in the table are set such that at a selected engine speed, a maximum allowable engine output for a first one of the plurality of candidate firing fractions is higher than a maximum allowable engine output for a second one of the plurality of candidate firing fractions, the second one of the candidate firing fractions being higher than the first one of the candidate firing fractions.

22. The engine controller of claim 21, further configured to fire the cylinders of the engine in a dynamic skip fire manner in accordance with a periodic selection of different operational firing fractions in response to varying demands placed on the engine.

23. The engine controller of claim 21, further configured to:

ascertain a base firing fraction for the desired output of the engine and an engine speed;

use the ascertained base firing fraction to identify in the table a first firing fraction;

determine if the first firing fraction is suitable to be the operational firing fraction by (a) calculating a candidate cylinder load for the engine operating at an engine load fraction and the first firing fraction and (b) comparing the calculated candidate cylinder load to the cylinder load threshold for the first firing fraction; and select the first firing fraction as the operational firing fraction if the calculated candidate cylinder load is less than the cylinder load threshold.

24. The engine controller of claim 23, further configured to step through one or more additional firing fraction entries in the table until an allowable firing fraction is found if the first firing fraction is not selected as the operational firing fraction, wherein the allowable firing fraction is designated as the operational firing fraction.

25. The engine controller of claim 21, wherein the plurality of cylinder load thresholds in the table are further indexed using one or more of the following parameters: gear shift, engine idle, accelerator pedal position, and a rate of change in the accelerator pedal position.

* * * * *